United States Patent [19]

Silverstein

[11] 4,203,854

[45] May 20, 1980

[54] STABLE LUBRICANT COMPOSITION CONTAINING MOLYBDENUM DISULFIDE AND METHOD OF PREPARING SAME

[75] Inventor: Joseph J. Silverstein, Woodmere, N.Y.

[73] Assignee: The Ore-Lube Corporation, New York, N.Y.

[21] Appl. No.: 939,236

[22] Filed: Sep. 5, 1978

Related U.S. Application Data

[63] Continuation of Ser. No. 785,812, Apr. 8, 1977, abandoned, which is a continuation of Ser. No. 663,552, Apr. 8, 1977, abandoned, which is a continuation of Ser. No. 444,125, Feb. 20, 1974, abandoned, which is a continuation-in-part of Ser. No. 278,153, Aug. 4, 1972, abandoned.

[51] Int. Cl.[2] ..... C10M 1/10

[52] U.S. Cl. ..... 252/25; 252/18

[58] Field of Search ..... 252/25, 18

[56] References Cited

U.S. PATENT DOCUMENTS

| | | | |
|---|---|---|---|
| 2,296,399 | 9/1942 | Otto et al. | 252/59 X |
| 2,371,656 | 3/1945 | Smith et al. | 252/52 R X |
| 2,375,007 | 5/1945 | Larsen et al. | 252/32.7 E |
| 3,125,520 | 3/1964 | Myers | 252/25 |
| 3,219,666 | 11/1965 | Norman et al. | 252/51.5 A X |
| 3,281,355 | 10/1966 | Cyphers et al. | 252/25 X |
| 3,344,068 | 9/1967 | Waight et al. | 252/47.5 |
| 3,554,911 | 1/1971 | Schiff et al. | 252/59 |
| 3,801,503 | 4/1974 | Hartmann | 252/25 |
| 3,842,009 | 10/1974 | Barry et al. | 252/25 |
| 4,119,547 | 10/1978 | Nachtman et al. | 252/25 |

OTHER PUBLICATIONS

Kalichevsky et al., "Petroleum Refining with Chemicals", 1956, pp. 549–552, 563–581, 613–618.

*Primary Examiner*—Andrew Metz

*Attorney, Agent, or Firm*—F. W. Guay & Associates

[57] ABSTRACT

A lubricating fluid comprising a refined petroleum base stock containing minor controlled amounts of each of a finely-divided, particulate molybdenum disulfide, a viscosity index improver, an anti-wear agent and a corrosion inhibitor.

19 Claims, No Drawings

STABLE LUBRICANT COMPOSITION CONTAINING MOLYBDENUM DISULFIDE AND METHOD OF PREPARING SAME

This is a continuation, of Application Ser. No. 785,812, filed Apr. 8, 1977 and now abandoned which is a continuation of Ser. No. 663,552, filed Apr. 8, 1977 and now abandoned; which is a continuation of Ser. No. 444,125, filed Feb. 20, 1974 and now abandoned; and which is a continuation-in-part of Ser. No. 278,153, filed Aug. 4, 1972 and now abandoned.

BACKGROUND

What with ecologists beating the drums for purer atmospheric conditions and what with manufacturers of internal combustion engines locked in life or death struggles for superior engine horsepower, it is small wonder that lubricant producers and suppliers feel threatened by the jaws of a vise. To their credit, however, they have expended untold energies to meet the challenge; to their dismay, on the other hand, many have met with limited success.

This is not too surprising when one considers the stringent specifications and the many requirements imposed on them. Typical of these requirements for today's lubricant are: reduced evaporative emissions; high temperature stability; reduced carbon emission; reduced blow-by; all seasons performance; reduced carbon, sludge and gum buildup; extreme pressure resistance; long life; stable viscosity; increased power output; increased gas mileage; better resistance to deterioration; good pumpability and fluidity at low temperatures; etc.; etc.

Of course, owners of buses, taxi fleets, racing cars, conventional automobiles, heavy duty equipment (including on and off the road vehicles), all are insisting upon the better lubricant. Environmental protection agencies, legislators and concerned citizens are not only casting a jaundiced eye at pollution sources, vehicular or otherwise, but they are doing something about it.

It is therefore an object of the present invention to meet the challenge of today with a superior motor oil for, say, diesel and gasoline engines, for heavy duty and touring vehicles, etc., under a wide variety of demanding conditions. Another object of the present invention is to provide an ecologically and economically desirable motor oil with significantly enhanced properties, such as, to name a few, low carbon emission, significant reduction in sludge, carbon and gum buildup, much longer life, reduced engine wear and fuel consumption, excellent stability. These and many other advantages and objects will be apparent from the description, infra, of the present invention.

INVENTION

The present invention relates to a superior, long life lubricating fluid comprising a petroleum base stock, e.g., a naphthenic base oil, containing controlled amounts of each of a finely-divided, particulate molybdenum disulfide and a viscosity index improver and minor amounts of an anti-wear agent and a corrosion inhibitor. According to certain preferred embodiments, minor proportions of any or all of the following may be added: an antifoam agent, an extreme pressure (E.P.) agent, a pour point depressant, a detergent, a dispersant, and other like additives for general or specific end uses intended for the oil. Certain individual additives provide several of the functions desired; for instance, an additive may act as both an E.P. and an anti-wear agent. Likewise, several different anti-wear or corrosion inhibitors may comprise the total concentration herein contemplated for each of these additives.

According to the instant discovery, the petroleum base stock is present in the concentration of at least about 62 up to about 98.5 percent, by volume, preferably at least about 76 up to about 96 percent; finely-divided molybdenum disulfide having a particulate size in the range of about 0.15 to about 0.9 micron, preferably from about 0.2 to about 0.55 micron, is present in the concentration range of about 0.25 to about 1.25 percent, by volume, preferably from about 0.45 to about 1.10; the viscosity index improver, e.g., linear polyisobutylene, polymethacrylate, or the like, in the concentration range of about 0.60 to about 1.75 percent, by volume, preferably from about 0.75 to about 1.40; the anti-wear agent is in the concentration of about 0.75 to about 3.00 percent, by volume, preferably from about 0.95 to about 2.50; and the corrosion inhibitor in the concentration range of about 0.25 and about 2.00, preferably from about 0.50 to about 1.75.

The base oil contemplated herein is a lubricating oil fraction of petroleum, either naphthenic or paraffinic base, unrefined, acid refined or solvent refined. Typical and preferred are the naphthenic base oils, e.g., alicyclic or cycloaliphatic saturated hydrocarbon having, generally, five (5) or six (6) carbon atoms in the ring. The $C_5$ or $C_6$ saturated cyclic hydrocarbon may be substituted with alkly moieties, e.g., a lower alkyl. Naphthenic fractions from Gulf Coast or California naphthenic base crudes, for example, are very suitable, as well as blends of these fractions.

The SAE 10 through 40 oils are preferred. The more desirable viscosities at 210° F. (99° C.), kinematic, centistokes, evaluated according to the American Society for Testing and Materials standard test method ASTM D-445, are, for example, minimum to maximum: from about 5.7 to less than about 7.5 for SAE 10; from about 7.5 to less than about 9.6 for SAE 20; from about 9.6 to less than about 12.9 for SAE 30; and from about 12.9 to less than about 16.8 for SAE 40.

Other properties of the SAE 10 to 40 oils contemplated herein are: a minimum viscosity index (ASTM D-2270) of about 70 and a maximum viscosity index of about 150, preferably from about 85 to about 125; a flash point (ASTM D-92) in °F. from about 250 to about 550, preferably from about 400 to about 500; a pour point maximum in °F. (ASTM D-97) from about −30 to about 20, preferably from about −20 to about 7; a (ASTM D-287) gravity, °API, from about 24.5 to about 32.5, preferably from about 26.0 to about 30; and, preferably, the oils should contain less than about one (1) percent sulfated ash (residue) as measured by ASTM D-874.

The concentration of viscosity index improver, such as an oil-soluble linear polyisobutylene having a relatively high molecular weight, is important to the lubricant of the present invention. If desired, a blend of different viscosity index improvers may be used, including oil-soluble isobutylene polymers of different molecular weights. Preferably, however, the molecular weight of the linear polyisobutylene viscosity index (V.I.) improver is in the range of 120,000 to 250,000, preferably between about 190,000 and 230,000.

As suggested above, other V.I. improvers, such as polymethacrylates are herein contemplated. Typical polymethacrylates are those having the general formula

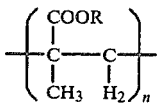

wherein R is an alkyl moiety having from about 4 to about 20 carbon atoms, the R moieties being the same or there being a mixture of R moieties in any given polymer, and n is a number provide an average molecular weight of the polymer of about 100,000 to about 750,000, preferably from about 150,000 to about 400,000. Various polymethacrylates of this type are known which possess viscosity index improving properties. A very satisfactory material of this type is a polymer of alkyl ($C_4$–$C_{14}$) methacrylate monomers. A commercial polymethacrylate, of the formula just above, which is primarily a viscosity index improver, is sold under the trademark "Acryloid 710" (Rohm & Haas Co., Philadelphia, Penna.), wherein R comprises about 50 percent lauryl and 50 percent octyl moieties and the average molecular weight of the polymethacrylate is about 560,000. Another commercially available polymethacrylate of the formula just above is "Acryloid 615" wherein the alkyl moieties are a mixture of alkyls derived from Oxo alcohols and the polymer likewise has an average molecular weight of about 560,000. Still another suitable polymethacrylate of the formula just above is available under the trademark "Acryloid 150", in which the alkyl moieties are predominantly a mixture of 50% cetyl, 25% lauryl and 25% octyl, and the polymethacrylate has an average molecular weight of about 650,000. Other suitable commercial "Acryloid" polymethacrylate viscosity index improvers are the following: "Acryloid 772", average molecular weight 700,000; "Acryloid 953", average molecular weight 660,000; "Acryloid 954", average molecular weight 500,000; "Acryloid 955", average molecular weight 350,000; and "Acryloid 956", average molecular weight 210,000.

A small particle size of the finely-divided molybdenum disulfide ($MoS_2$) solids contemplated herein is very important in order to achieve the very desirable properties hereinabove described. Quite surprisingly, it has been found according to the present invention that the $MoS_2$ particulates may be uniformly dispersed throughout the base oil without the heretofore cumbersome necessity of, for example, reacting an aqueous or alcohol molybdenum salt solution, such as an aqueous molybdenum halide solution, with hydrogen sulfide in the presence of a lubricating oil detergent additive, such as a petroleum sulfonate, thus preparing the molybdenum sulfide in situ. The water in the resulting blend is subsequently removed.

Another cumbersome process heretofore employed involved reacting $H_2S$ with an aqueous molybdenum salt solution and dispersing the resulting molybdenum sulfide precipitate in the $H_2O$ by the use of a lyophilic (protecting) colloid, e.g., gelatin. The resulting sol is, in turn, mixed with alcohol and a lubricating oil solution containing, say, a metal sulfonate, such as calcium sulfonate. The effect of this is that colloidal metal sulfide is extracted from said sol and redispersed in the lubricating oil. Residual water and alcohol are then removed from the mixture to isolate the colloidal dispersion of metal sulfide in lubricating oil.

Pursuant to the present invention, the aforedescribed onerous processes, intended to overcome the metal sulfide precipitation curse, have been supplanted. According to one embodiment of the instant discovery, the $MoS_2$ particulates in finely-divided form, i.e., having a critical particle size in the range of about 0.15 to about 0.9 micron, preferably about 0.2 to about 0.55 micron, are first thoroughly blended with viscosity index improver and base oil, both of the type contemplated herein, and the resulting homogeneous dispersion admixed with the balance of the components.

Typically, from about 5 to about 15 percent by volume, preferably from about 6.5 to about 12 percent by volume of (a) $MoS_2$ particulates, say, about 0.33 micron average particle size, are mixed with from about 5 to about 15 percent, by volume, preferably from about 6.5 to about 12 percent, of (b) viscosity index improver, such as a polymethacrylate of the type hereinbefore described, and from about 70 to about 90 percent, preferably from about 75 to about 87.5 percent of (c) base oil, likewise of the type herein described. The resulting dispersion is then intimately blended with the balance of the components to provide the product of the present invention containing the balance of the base oil, viscosity index improver, $MoS_2$, antiwear agent, corrosion inhibitor, and any other conventional additives, including antifoam agents, pour point depressants, extreme pressure (E.P.) agents, detergents, and the like.

Another embodiment within the purview of the present discovery involves preparing concentrates from the aforedescribed dispersion of $MoS_2$ in viscosisty index improver and base oil, which concentrates have the advantage of being blended into end use solutions at the place of use, thus avoiding high freight or shipping costs. Surprisingly enough, according to the present invention, neither the final solutions nor the concentrates suffer from the intolerable precipitation curse described in the prior art.

One of the preferred concentrates comprises, by volume, from about 20 to about 42%, preferably from about 25 to about 38.5 percent, of the above dispersion with from about 4 to about 10% corrosion inhibitor, preferably from about 5 to about 8%, from about 4 to about 11.5% antiwear agent, preferably from about 6 to about 9.5%. and the balance base oil. Preferably up to about 2.5% antifoam agent is present.

Alternatively, the concentrate may comprise, by volume, from about 65 to about 88% of the above dispersion, preferably from about 75 to about 85%, from about 7 to about 13% corrosion inhibitor, preferably from about 8.5 to about 11.5%, from about 6.75 to about 11% anti-wear agent, preferably from about 7.75 to about 10.2%, and the balance base oil. Again, up to about 2.5% antifoam agent, generally about 1%, is desirable. Further, the dispersion and the remaining components are best heated to effect intimate blending and a homogeneous mixture.

While the latter two are preferred embodiments, concentrations intermediate the ranges given may be used providing broad ranges of about 20 to about 88% dispersion, about 4 to about 13% corrosion inhibitor and about 4 to about 11.5% anti-wear agent, the balance being base oil.

In addition to significantly enhancing the lubricant of the present invention in the manner suggested hereinbefore, the colloidal molybdenum disulfide protects against corrosion and wear.

Particularly desirable corrosion inhibitors, pursuant to the present invention, are the so-called hindered phenols. These are compounds having one or more phenolic rings with at least one tertiary alkyl (lower) group, usually tertiary butyl, per ring located ortho to a phenolic hydroxyl moiety to sterically hinder its reactivity. Hindered phenols as a class are well known. Illustrative examples thereof include 4,4'-thio-bis(6-tertiary butyl-m-cresol); 4,4'-thio-bis(6-tertiary butyl-o-cresol); 2-6-di(tertiary butyl)-p-cresol; 4,4'-methylene bis(2,6-di-tertiary butyl phenol); 2,6-di-tertiary butyl-alphadimethylamino-p-cresol; 2,6-di-tertiary butyl-alpha-methoxy-p-cresol; 2,6-di-tertiary butyl phenol; and mixed tertiary butyl-phenols such as those containing at least 75% of 2,6-di-tertiary butyl phenol; 4,4'-methylene bis (6-tertiary butyl-o-cresol); 2,2'-methylene bis(4-methyl-6-tertiary butylphenol); and 2,2'-methylene bis(4-ethyl-6-tertiary butyl-phenol); and the like.

Other contemplated oxidation and rust inhibitors within the purview of the present invention include the oil-soluble polyvalent metal salts derived from a wide variety of diester dithiophosphoric acids conventionally prepared by reacting a sulfide of phosphorus, such as phosphorous pentasulfide, with an alcohol, phenol or mercaptan. These salts have anti-wear properties as well and have the structure

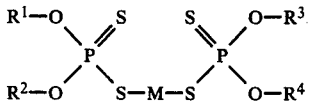

wherein $R^1$ to $R^4$ in the acid esters each represents substituted or unsubstituted aryl (e.g., phenyl), alkyl, aralkyl, cycloalkyl or other monovalent hydrocarbon moieties which contain from about 3 to 20 carbon atoms, preferably about 3 to 12 carbon atoms, $R^1$ through $R^4$ being the same or different. Of the polyvalent metals designated M in the above structure, zinc is preferred but other metals of 28 to 30 atomic number, such as nickel or copper, are suitable. Alcohols which may be employed in preparing the acid esters include primary and secondary alcohols, such as 4-methyl-pentanol-2, 2-methylpentanol-1, 2-ethylhexanol, di-isopropyl carbinol, cyclohexanol, butanol-1, isopropanol and octadecanol-1, or mixtures of high and low molecular weight alcohols. The preferred compounds are the zinc dialkyl dithiophosphates wherein the alkyl group contains about 3 to 12 carbon atoms, preferably about 3 to 8 carbon atoms. More specifically, the preferred dialkyl dithiophosphates include, for instance, dihexyl dithiophosphate, diheptyl dithiophosphate, di-2-methylamyl dithiophosphate, di-2-ethylhexyl dithiophosphate, and the like.

Still other anti-oxidants and anti-corrosion additives suitable for use herein are the oil-soluble alkaline earth metal thiophenates having the structural formula:

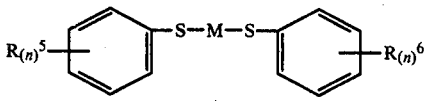

wherein M is an alkaline earth metal, $R^5$ and $R^6$ each represent a monovalent hydrocarbon moiety containing from about 3 to 20, preferably about 3 to 12 carbon atoms, and n is an integer of 0 to 3, $R^5$ and $R^6$ being the same or different. Of the alkaline earth metals, calcium is preferred, but other divalent metals belonging to Group II of the Periodic Table, such as beryllium, barium, strontium and magnesium may be used. As in the case of the metal dialky dithiophosphates discussed above, the monovalent hydrocarbon moieties $R^5$ and $R^6$ may be aryl (e.g., phenyl), alkyl, arakyl, cycloalkyl, and the like, and may be further substituted in the organic portion. Preferably, $R^5$ and $R^6$ each represent an alkyl group of 3 to 12 carbon atoms, such as n-propyl, isopropyl, butyl, amyl, hexyl, cyclohexyl, octyl, nonyl, decyl, undecyl, dodecyl, and the like. Some examples of the preferred alkaline earth metal thiophenates useful as antioxidants in the compositions of the present invention are the calcium salts of amyl thiophenate, cyclohexyl thiophenate, 2,4-dioctyl thiophenate, 2,4-ethylhexyl thiophenate, and the like.

Of course, the person skilled in the art will appreciate the fact that other corrosion inhibitors may be used alone or conjointly with the above, including p,p'-dioctyldiphenylamine, phenyl-beta-naphthylamine, and the like.

Particularly desirable anti-wear agents within the purview of the instant discovery are the antimony dialkyl dithiocarbamates wherein the alkyl moiety has from two (2) to fourteen (14) carbons, e.g., ethyl, n-butyl, amyl, hexyl, octyl, decyl, dodecyl, and the like. Generally, as indicated hereinbefore, from about 1.10 to about 3.0 percent by volume, based upon the total volume of the lubricant composition, is used. While the aforementioned antimony dialkyl dithiocarbamates are preferred as anti-wear agents, other well-known anti-wear agents soluble in petroleum hydrocarbons may be used in lieu thereof or in combination therewith, including the metal salts of diorganodithiophosphates likewise hereinbefore discussed, particularly the antimony O,O-dialkyl phosphorodithioates, such alkyl moieties being, say, n-propyl, isopropyl, isobutyl, amyl, hexyl and 2-ethylhexyl, and other like antiwear agents.

If desired, as suggested hereinbefore, conventional antifoam agents, E.P. agents, pour point depressants, detergents, dispersants, and antioxidants may be incorporated herein in conventional concentrations. Typical of the antifoam agents are the well-known, commercially available liquid silicone polymers, such as dimethyl silicone polymer, diethyl silicone polymer, methyl ethyl silicone polymer, diphenyl silicone polymer, phenyl ethyl silicone polymer, methyl phenyl silicone polymer, and other dihydrocarbon silicone polymers, such as disclosed in U.S. Pat. No. 2,373,007.

If desired, minor amounts of basic aromatic sulfonates may be added, generally less than about one (1) percent, by volume, usually less than 0.25 percent, based upon the total volume of the lubricant composition. The sulfonates are effective, among other things, in neutralizing sulfur and nitrogen compounds present during lubrication.

The basic sulfonates can be prepared by neutralizing aromatic sulfonic acids with a theoretical excess of the hydroxides, chlorides, oxides or other inorganic compounds of the alkaline earth metals so as to obtain a product which contains an amount of alkaline earth metal in excess of that theoretically required to replace the acidic hydrogens of the sulfonic acids. The preferred alkaline earth metal is barium. Generally preferred aromatic sulfonic acids are the oil-soluble mahogany sulfonic acids which can be derived from the treatment of a suitable petroleum oil, such as a liquid petroleum distillate boiling in the range of about 600° to 1000° F., with fuming sulfuric acid or sulfur trioxide, separating the resulting acid sludge from the acid treated oil and recovering the mahogany acids contained in the acid treated oil. The useful mahogany acids generally have a molecular weight of from about 300 to 500 or more, and although their exact chemical structures may vary, it appears that such acids are composed to a large extent of sulfonated aromatic hydrocarbons having either one or two aromatic rings per molecule, possibly with one or more long chain alkyl groups containing from about 8 to 30 carbons atoms attached to the ring nuclei.

From about 5 to about 25%, preferably about 9 to about 16%, based upon the total volume of final ready-to-use oil compositions of the present invention may comprise a synthetic diester lubricant base, to provide a wider thermal operating range. Typical organic diesters are the dialkyl (lower) and glycol dipelargonates and azelates, i.e., the C9 nonanoic and nonanedioic acid esters.

Of course, other conventional additives of the type herein described may be present in likewise conventional concentrations. Typical are the pour point depressants, such as hydrocarbon wax-naphthalene condensates of the Friedel-Crafts type having, typically, the following properties:

| | |
|---|---|
| Viscosity at 210° F. SSU | 308 |
| Flash point, °F. | 450 |
| Pour point, °F. | +55 |
| Conradson carbon, wt per cent | 1.9 |
| Density, lb/gal at 60° F. | 7.5 |

A suitable detergent/dispersant, for instance, in Santolube 801 (Monsanto Company) which has the following properties:

| | |
|---|---|
| Specific gravity 60/60° F. | 1.03 |
| Viscosity 210° F., SUS ca. | 180 |
| Pour point, °F.(max.) | 30 |
| Barium, % wt., min | 11.8 |
| Phosphorus, % wt., min. | 1.3 |
| Sulfur, % wt., min | 0.7 |

EXAMPLES

The examples which follow are illustrative only and not intended to unduly limit the scope of the present invention.

EXAMPLE I

A mixture of base oil, molybdenum disulfide solids and polymethacrylate viscosity index improver is prepared by preliminarily blending in a high shear mixer the following components until a homogeneous dispersion results:

| Component | Percent by Volume |
|---|---|
| Naphthenic oil base (SAE 30) | 80 |
| Viscosity, kinematic, centistokes, at 210° F.(ASTM D-445) = 12.6 | |
| Viscosity index (ASTM D-2270) = 104.0 | |
| Flash point, °F. (ASTM D-92) = 460.0 | |
| Pour point, °F. (ASTM D-97) = −5.0 | |
| Gravity, °API (ASTM D-287) = 27.1 | |
| Sulfated ash (by weight) = <1% | |
| $MoS_2$ - finely divided - 0.33 micron particle size | 10 |
| Acryloid 710 polymethacrylate viscosity index improver (Rohm & Haas Co); polymethacrylate wherein R comprises about 50 percent lauryl and 50% octyl moieties; average molecular weight about 560,000 | 10 |

-continued

To this homogeneous disperson [which can be called component (A)] is then added, while agitating (stirring), more of the same naphthenic oil base (SAE 30), as well as the following components in sufficient concentrations to form a concentrate blend having the following makeup:

| Component | | Percent by Volume |
|---|---|---|
| Component (A) | | *35.00 |
| Antimony dihexyl dithiocarbamate | | 8.00 |
| Viscosity, SSU at 210° F. | 65 | |
| Flash point, COC, °F. | 350 | |
| Specific gravity | 1.04 | |
| Antimony, weight per cent | 6.8 | |
| Sulfur, weight per cent | 10.9 | |
| 2,6-Di(tertiary butyl)-p-cresol | | 7.00 |
| Viscosity at 100° F., SSU | 59 | |
| Flash point, °F. | 285 | |
| Pour point, °F. | −30 | |
| Specific gravity, 60°/60° F. | 0.876 | |
| Density, lb./gal. at 60° F. | 7.3 | |
| Zinc, weight per cent | 0.22 | |
| Ash, weight per cent | 0.33 | |
| Conradson carbon, wt per cent | 0.40 | |
| Liquid dimethyl silicone | | 1.0 |
| Silicone content wt. per cent | 100.0 | |
| Specific gravity 25°/25° C. | 1.0 | |
| Viscosity, centipoise at 25° C. | 500 (max.) | |
| Flash point, °F. open cup | 600 (min.) | |
| Naphthenic oil base (same oil as in homogeneous dispersion above) | | 49.0 |

*provides only 28% of the base oil

EXAMPLE II

Example I is repeated in every essential respect with the exception that component (A) and the remaining components are blended in the following higher concentrations:

| Component | Percent by Volume |
|---|---|
| Component (A) | 80.00 |
| Antimony dihexyl dithiocarbamate | 9.00 |
| 2,6-Di(tertiary butyl)-p-cresol | 10.00 |
| Liquid dimethyl silicone | 1.00 |

Blending is enhanced by applying heat to the mixture while mixing.

EXAMPLE III

The product concentrate of Example I, which contains 77%* of the naphthenic oil base, by volume, is diluted before use as a motor oil, for instance, with additional of the same naphthenic oil base to provide the following final concentrations:

* 28% from Component A and 49% added.

| Component | Percent by Volume |
|---|---|
| Antimony dihexyl dithiocarbamate | 2.00 |
| Acryloid 710 polymethacrylate | 0.875 |
| $MoS_2$ | 0.875 |
| 2,6-Di(tertiary butyl)-p-cresol | 1.75 |
| Liquid dimethyl silicone | 0.25 |
| Naphthenic oil base | 94.27 |

EXAMPLE IV

The product concentrate of Example II, which contains 64% of the naphthenic oil base, by volume, is diluted before use as a motor oil, for instance, with additional of the same naphthenic oil base to provide the following final concentrations:

| Component | Percent by Volume |
|---|---|
| Antimony dihexyl dithiocarbamate | 1.125 |
| Acryloid 710 polymethacrylate | 1.00 |
| $MoS_2$ | 1.00 |
| 2,6-Di(tertiary butyl)-p-cresol | 1.25 |
| Liquid dimethyl silicone | 0.125 |
| Naphthenic oil base | 95.50 |

EXAMPLE V

Example III is repeated in every essential with the exception that the polymethacrylate viscosity index improver has an ave.molecular weight of 210,000 (Acryloid 956 from Rohm & Haas Co., Philadelphia, Pennsylvania).

EXAMPLE VI

Example IV is repeated in every essential respect with the exception that the polymethacrylate viscosity index improver has an average molecular weight of 210,000 (Acryloid 956 from Rohm & Haas Co.)

EXAMPLE VII

Example III is repeated in every essential respect with the exception that the viscosity index improver is a linear isobutylene polymer having the following properties:

| | |
|---|---|
| Molecular weight about 200,000 | |
| Viscosity at 210° F., cs | 645 |
| Specific gravity, 60°/60° F. | 0.875 |
| Density, lb./gal. at 60° F. | 7.30 |

EXAMPLE VIII

Example IV is repeated in every essential respect with the exception that the viscosity index improver of Example VII is substituted for the polymethacrylate.

EXAMPLE IX

Example III is repeated in every essential respect with the exception that antimony dibutyl dithiocarbamate is used in lieu of antimony dihexyl dithiocarbamate.

EXAMPLE X

Example IV is repeated in every essential respect with the exception that the zinc di-2-methylamyl dithiophosphate is used in lieu of 2,6-di(tertiary butyl)-p-cresol.

EXAMPLE XI

Example V is repeated in every essential respect with the exception that the calcium salt of cyclohexyl thiophenate is present in the concentration of 0.95%, by volume, as an oxidation and rust inhibitor and all concentrations modified accordingly.

EXAMPLE XII

Example VI is repeated in every essential respect with the exception that the naphthenic oil base is present in the concentration of 91.00 percent by volume, and 0.30 percent by volume of a polymeric pour point depressant is added, all other concentrations being increased proportionately, the pour point depressant being Santopour C (Monsanto Company) which has the following properties:

| | |
|---|---|
| Gravity, API | 24 |
| Specific Gravity, 60°/60° F. | 0.91 |
| Flash Point (COC) | 300° F. |
| Viscosity 210° F., SUS | 811 |
| Neutralization Number | 7 |

EXAMPLE XIII

Example V is repeated in every essential respect with the exception that naphthenic oil base (SAE 20) is used having the following properties:

Viscosity, kinematic, centistokes, at 210° F. (ASTM D-445)=9.30
Viscosity index (ASTM D-2270)=109.00
Flash point, °F. (ASTM D-92)=445.00
Pour point, °F. (ASTM D-97)=−5.0
Gravity, °API (ASTM D-287)=28.3
Sulfated ash (by weight)=<1%

EXAMPLE XIV

Example V is repeated in every essential respect with the exception that the concentration of naphthenic oil base in the final oil composition is 76.27%, by volume, and the difference of 18% is substituted by the diester lubricant base di-2-ethyl-hexyl azelate (pour point −100° F., Emery Industries, Cincinnati, Ohio) to widen thermal operating range.

EXAMPLE XV

Example VI is repeated in every essential respect with the exception that the following naphthenic oil base is substituted for the SAE 30:

Naphthenic oil base (SAE 10)
Viscosity, kinematic, centistokes, at 210° F. (ASTM D-445)=6.8
Viscosity index (ASTM D-2270)=116.0
Flash point, °F. (ASTM D-92)=435.0
Pour point, °F. (ASTM D-97)=−20.0
Gravity, °API (ASTM D-287)=29.6
Sulfated ash (by weight)=<1%

EXAMPLE XVI

Example V is repeated in every essential respect with the exception that the following naphthenic oil base is substituted for the SAE 30:

Viscosity, kinematic, centistokes, at 210° F. (ASTM D-445)=14.4
Viscosity index (ASTM D-2270)=103.0
Flash point, °F. (ASTM D-92)=490.0

Pour point, °F. (ASTM D-97)=5.0
Gravity, °API (ASTM D-287)=26.7
Sulfated ash (by weight)=<1%
SAE=40

EXAMPLE XVII

Example I is repeated in every essential respect with the exception that 6.7% $MoS_2$ and 14.0% viscosity index improver are employed, the balance (to 100%) being the naphthenic oil base (SAW 30).

EXAMPLE XVIII

Example I is repeated in every essential respect with the exception that in forming the concentrate 4.0% antimony dihexyl dithiocarbamate and 4.0% 2,6-di(tertiary butyl)-p-cresol are used.

EXAMPLE XIX

Example I is repeated in every essential respect with the exception that in the dispersion 14.5% $MoS_2$ and 6.0% Acryloid 710 are used.

EXAMPLE XX

Example XVIII is repeated in every essential respect with the exception that the product concentrate is diluted before use as a motor oil, for instance, with additional of the same naphthenic oil base to provide the following concentrations:

| Component | Percent by Volume |
|---|---|
| Antimony dihexyl dithiocarbamate | 1.00 |
| Acryloid 710 polymethacrylate | 0.875 |
| $MoS_2$ | 0.875 |
| 2,6-Di(tertiary butyl)-p-cresol | 1.00 |
| Liquid dimethyl silicone | 1.00 |
| Naphthenic oil base | 95.25 |

EXAMPLE XXI

Example VI is repeated in every essential respect with the exception that the hindered phenol is 2,6-ditertiary butyl phenol.

The lubricants illustrated in the above examples exhibit much long life, reduced engine wear and fuel consumption, excellent stability, low evaporative emission, low sludge, carbon and gum buildup, and many other very desirable properties of the type herebefore discussed.

Pursuant to statutory requirements, there are described above the invention and what are now considered its best embodiments. It should be understood, however, that the invention can be practiced otherwise than as specifically described within the scope of the appended claims.

What is claimed is:

1. A stable lubricant composition for use as a motor oil which consists essentially of, by volume based upon the total volume of the lubricant composition, at least about 62 up to about 98.5 percent of a petroleum base oil; about 0.25 to about 1.25 percent of molybdenum disulfide particulates having a particle size in the range of about 0.15 to about 0.9 microns; about 0.60 to about 1.75 percent of an oil-soluble polymethacrylate viscosity index improver having a molecular weight in the range of about 100,000 to about 750,000; about 0.75 to about 3.00 percent of an anti-wear agent; and about 0.25 to about 2.00 percent corrosion inhibitor.

2. The lubricant composition of claim 1 wherein the concentrations are, by volume, at least 76 to about 96 percent petroleum base oil; about 0.45 to about 1.10 percent of the molybdenum disulfide; about 0.75 to about 1.40 percent of the oil-soluble viscosity index improver; about 0.95 to about 2.50 percent anti-wear agent; and about 0.50 to about 1.75 percent corrosion inhibitor.

3. The lubricant composition of claim 1 wherein the petroleum base oil is selected from SAE 10 through SAE 40.

4. The lubricant composition of claim 3 wherein the corrosion inhibitor is 2,6-(tertiary butyl)-p-cresol.

5. The lubricant composition of claim 3 which contains a small but effective amount of silicone polymer foam inhibitor.

6. The lubricant composition of claim 5 wherein the anti-wear agent is antimony dihexyl dithiocarbamate.

7. The lubricant composition of claim 3 wherein the petroleum base oil has a viscosity at 210° F. (99° C.), kinematic, centistokes in the range of about 5.7 to less than about 16.8; a viscosity index from about 70 to about 150; a flash point in °F. from about 250 to about 550; a pour point in °F. from about −30 to about 20; and a gravity, °API, from about 24.5 to about 32.5.

8. A stable concentrate suitable for preparing a lubricant composition for use as a motor oil by the addition of more petroleum base oil which concentrate consists essentially of, by volume, from about 20 to about 88 percent dispersion, from about 4 to about 13 percent corrosion inhibitor, from about 4 to 11.5 percent anti-wear agent and sufficient petroleum base oil, if needed, to make 100% by volume, said dispersion consisting essentially of, by volume, from about 5 to 15 percent $MoS_2$ particulates having a particle size in the range of about 0.15 to about 0.9 micron, from about 5 to 15 percent polymethacrylate viscosity index improver having a molecular weight in the range of about 100,000 to 750,000, and from about 70 to about 90 percent petroleum base oil.

9. The concentrate of claim 8 wherein the petroleum base oil has a viscosity at 210° F. (99° C.), kinematic, centistokes in the range of about 5.7 to less than about 16.8; a viscosity index from about 70 to about 150; a flas point in °F. from about 250 to about 550; a pour point in °F. from about −30 to about 20; and a gravity, °API, from about 24.5 to about 32.5.

10. The concentrate of claim 9 wherein the corrosion inhibitor is a hindered phenol.

11. The concentrate of claim 10 containing, in addition, up to 2.5 percent, by volume, silicone antifoam agent.

12. A stable composition suitable for addition to a petroleum base motor oil to enhance the latter's properties as a motor oil, which composition consists essentially of, by volume, a dispersion of from about 5 to 15 percent $MoS_2$ particulates having a particle size in the range of about 0.15 to about 0.9 micron, from about 5 to 15 percent polymethacrylate oil-soluble viscosity index improver, and from about 70 to about 90 percent petroleum base oil.

13. The composition of claim 12 incorporated in petroleum base oil which has a viscosity at 210° F. (99° C.), kinematic, centistokes in the range of about 5.7 to less than about 16.8; a viscosity index from about 70 to about 150; a flash point in °F. from about 250 to about 550; a pour point in °F. from about −30 to about 20; and a gravity; °API, from about 24.5 to about 32.5.

14. The lubricant composition of claim 1 in which the polymethacrylate viscosity index improver has the following structural formula:

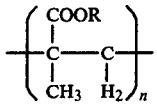

wherein R is an alkyl moiety having from about 4 to about 20 carbon atoms, the R moieties being the same or a mixture of alkyl moieties, and n is a number which provides an average molecular weight of the polymer of about 100,000 to about 750,000.

15. The concentrate of claim 8 in which the polymethacrylate viscosity index improver has the following structural formula:

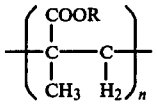

wherein R is an alkyl moiety having from about 4 to about 20 carbon atoms, the R moieties being the same or a mixture of alkyl moieties, and n is a number which provides an average molecular weight of the polymer of about 100,000 to about 750,000.

16. The concentrate of claim 12 in which the polymethacrylate viscosity index improver has the following structural formula:

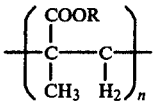

wherein R is an alkyl moiety having from about 4 to about 20 carbon atoms, the R moieties being the same or a mixture of alkyl moieties, and n is a number which provides an average molecular weight of the polymer of about 100,000 to about 750,000.

17. The stable composition of claim 1 produced by intimately blending the components of claim 1 until a homogeneous dispersion of the $MoS_2$ solids in the composition results.

18. The stable concentrate of claim 8 produced by intimately blending the components of claim 8 until a homogeneous dispersion of the $MoS_2$ solids in the concentrate results.

19. The stable composition of claim 12 produced by intimately blending the components of claim 12 until a homogeneous dispersion of the $MoS_2$ solids in the composition results.

* * * * *